United States Patent [19]

Hueffman et al.

[11] Patent Number: 4,822,074

[45] Date of Patent: Apr. 18, 1989

[54] RECORD KEEPING PAD AND PAGE THEREFOR

[76] Inventors: Jennifer R. Hueffman, 48 Winding Rd., Madison, Conn. 06443; Paul M. Boczar, 23 Nicoll St., New Haven, Conn. 06511

[21] Appl. No.: 170,864

[22] Filed: Mar. 21, 1988

[51] Int. Cl.[4] ..... B42D 5/00; B42D 1/00; B41L 1/20; B42B 5/00

[52] U.S. Cl. ..... 281/15.1; 281/2; 282/27 R; 283/63.1

[58] Field of Search ..... 281/1, 2, 3, 15 B, 15 R; 283/63 R; 229/22; 40/2; 312/183; 282/27 R

[56] References Cited

U.S. PATENT DOCUMENTS

| | | | |
|---|---|---|---|
| 2,123,903 | 7/1938 | Lane et al. | 281/15 R |
| 2,248,703 | 7/1941 | Friedman | 283/63 |
| 3,084,844 | 4/1963 | Rattner | 229/22 |
| 3,820,261 | 6/1974 | Beall, Jr. | 40/2 |
| 3,930,700 | 1/1976 | Figueres | 312/183 |
| 4,105,224 | 8/1978 | Rodebaugh | 281/15 R |
| 4,277,089 | 7/1981 | Lockhart | 282/27 |
| 4,477,103 | 10/1984 | Bertolkzzi | 281/2 |
| 4,508,365 | 4/1985 | Hawes | 281/2 |
| 4,558,888 | 12/1985 | Hanson et al. | 281/2 |
| 4,568,108 | 2/1986 | Simpson | 281/2 |
| 4,713,274 | 12/1987 | Minor | 281/15 R |
| 4,714,276 | 12/1987 | Greig | 283/63 R |

*Primary Examiner*—Frank T. Yost
*Assistant Examiner*—Paul M. Heyrana, Sr.
*Attorney, Agent, or Firm*—Richard A. Craig

[57] ABSTRACT

A composite page for use in a pad of such pages includes a paper sheet having a top surface, a bottom surface, a bindable end, a free end, sides joining the ends, a first perforation line spaced from the bindable end, and a second perforation line between the first perforation line and the free end, a first layer of pressure sensitive adhesive material localized on the portion of the top surface between the free end and the second perforation line, a second layer of pressure sensitive adhesive material on the bottom surface and covering at least the portion thereof between partly the first and second perforation lines. A pad is made up of a plurality like composite pages stacked together in the same orientation with the bindable ends of the paper sheets bound together and the top surfaces facing upward. A pad cover is movable between an open position and a closed position overlying the free ends of the paper sheets.

11 Claims, 4 Drawing Sheets

RECORD KEEPING PAD AND PAGE THEREFOR

BACKGROUND OF THE INVENTION

This invention relates to a record keeping pad, for use especially by professional and amateur photographers. The invention also relates to a page which is a component of the pad. More particularly, the invention facilitates the compilation of an accurate log of information for individual exposures and/or rolls of film, indicating such items of information as job number, date, client, exposure number, which information must be transferred to individual photographs or developed rolls of film.

There is no known pad or system for doing this. The reader is referred to the following prior U.S. Patents for background information hereon:

| U.S. Pat. No. | Date | Inventor |
|---|---|---|
| 2,248,703 | July 8, 1941 | Friedman |
| 3,084,844 | April 9, 1963 | Rattner |
| 3,820,261 | June 28, 1974 | Beall, Jr. |
| 3,930,700 | January 6, 1976 | Figueres |
| 4,277,089 | July 7, 1981 | Lockhart |

It is an important object of the invention to provide a record keeping pad for the above purposes, and a page which is a component of the pad.

It is another object of the invention to provide such a pad and such a page which are of simple, economical construction and which are simple to use.

The foregoing and additional objects and advantages will become apparent hereinafter.

SUMMARY OF THE INVENTION

An inventive composite page for use in a pad of such pages includes a paper sheet having a top surface, a bottom surface, a bindable end, a free end, sides joining the ends, a first perforation line spaced from the bindable end, and a second perforation line between the first perforation line and the free end, a first layer of pressure sensitive adhesive material localized on the portion of the top surface between the free end and the second perforation line, a second layer of pressure sensitive adhesive material on the bottom surface and covering at least partly the portion thereof between the first and second perforation lines. An inventive pad is made up of a plurality of like composite pages stacked together in the same orientation with the bindable ends of the paper sheets bound together and the top surfaces facing upward. A pad cover is movable between an open position and a closed position overlying the free ends of the paper sheets.

DESCRIPTION OF THE INVENTION

Figure 2:
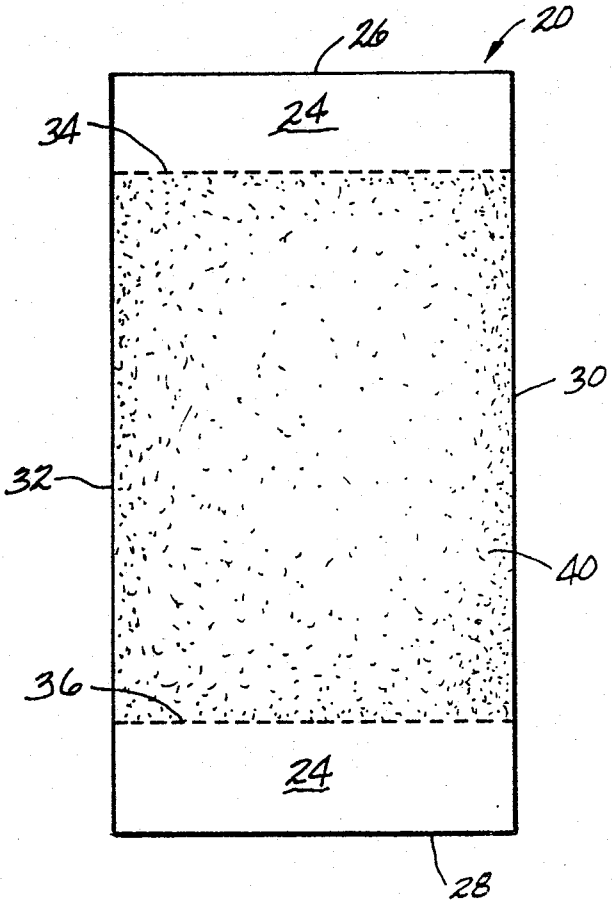
FIG. 2 is a bottom plan view of the partially completed composite page of FIG. 1.
Figure 1:
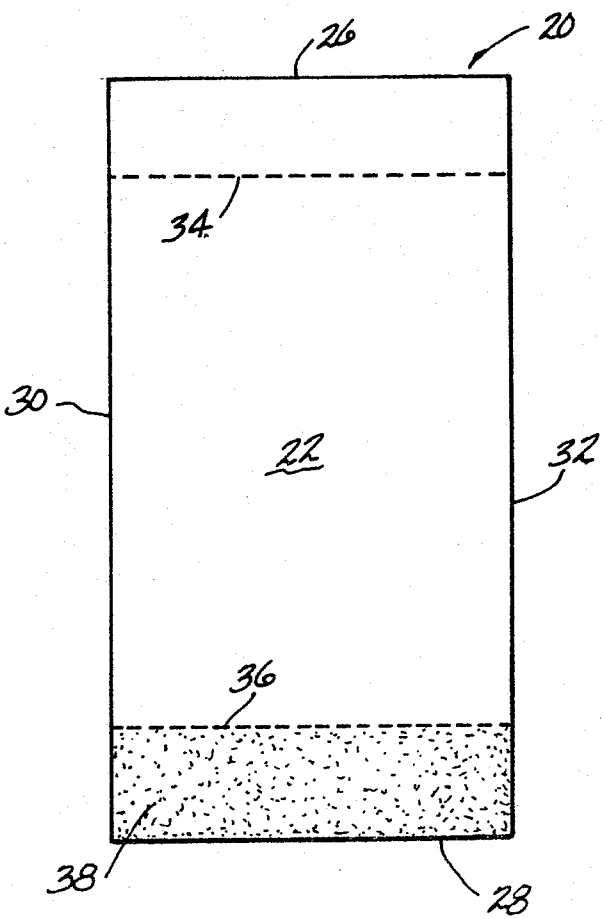
FIG. 1 is a top plan view of a partially completed composite page which is a preferred embodiment o the invention.

Reference is first made to FIGS. 1 and 2 which show in top plan view and bottom plan view, respectively, a rectangular paper sheet 20. Sheet 20 has a top surface 22 (FIG. 1), a bottom surface 24 (FIG. 2), a bindable end 26, a free end 28 parallel to end 26 and sides 30 and 32 perpendicular to and joining ends 26 and 28. Sheet 20 also has perforation lines 34 and 36 parallel to ends 26 and 28 and joining sides 30 and 32. Perforation lines 34 and 36 are, as shown, equally spaced from ends 26 and 28, respectively, a distance such that the distance between lines 34 and 36 is roughly 75% of the distance between ends 26 and 28.

Top surface 22 has thereon a localized layer 38 of pressure sensitive adhesive material covering the portion of top surface 22 circumscribed by free end 28, sides 30 and 32 and perforation line 36. The portion of top surface 22 between lines 34 and 36 provides a writing area, capable of being written on in pencil or pen.

As indicated by reference numeral 40 in FIG. 2, bottom surface 24 has thereon a layer of pressure sensitive adhesive material which covers the portion of surface 24 between perforation lines 34 and 36 as shown, layer 40 is localized on and covers all of that portion of surface 24. Layer 40 may be more extensive than is shown and may cover the entirety of surface 24.

Figure 4:
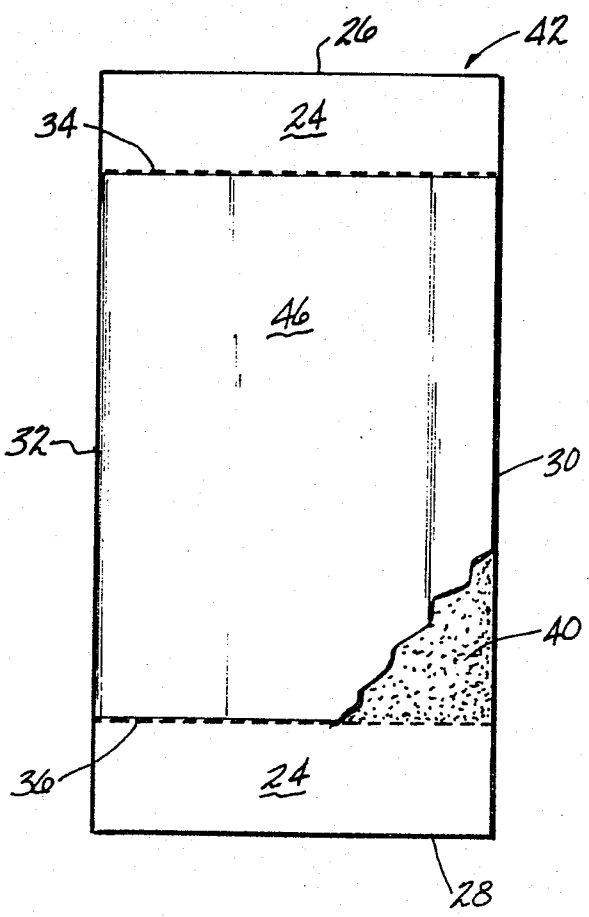
FIG. 4 is a view similar to FIG. 2 but showing the completed composite page in bottom plan view.
Figure 3:
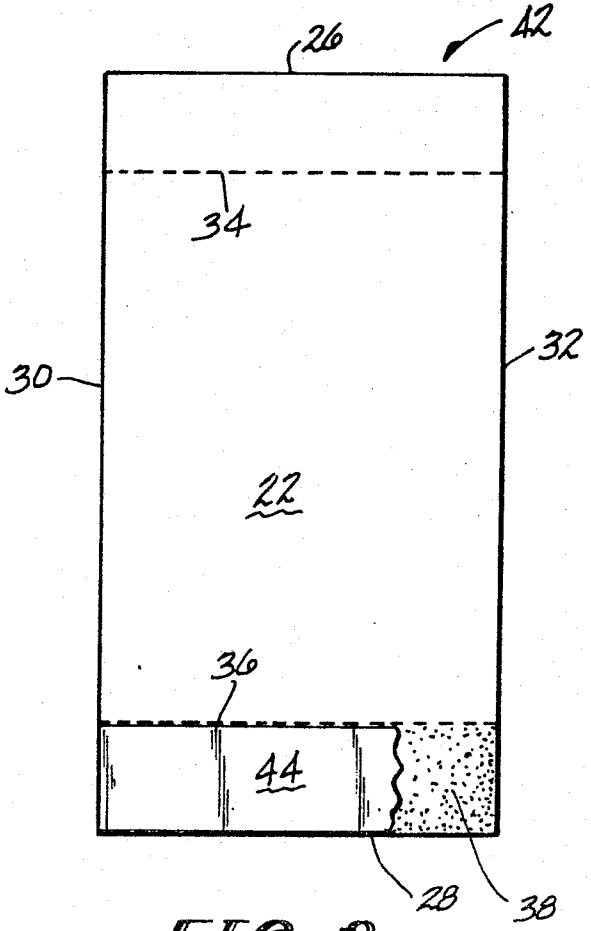
FIG. 3 is a view similar to FIG. 1 but showing the completed composite page in top plan view.

FIGS. 3 and 4 are similar to FIGS. 1 and 2, respectively, but illustrate a completed composite sheet 42. As seen in FIG. 3, a piece of release paper 44 is placed over and removably adhered to layer 38 of pressure sensitive adhesive material which covers the portion of top surface 22 circumscribed by free end 28, sides 30 and 32 and perforation line 36, as illustrated in FIG. 3, wherein release paper 44 is shown fragmentarily to expose layer 38 thereunder. A piece of release paper 46 is placed over and removably adhered to layer 40 of pressure sensitive adhesive material which is on bottom surface 24, as illustrated in FIG. 4, wherein release paper 46 is shown fragmentarily to expose layer 40 thereunder.

Figure 5:
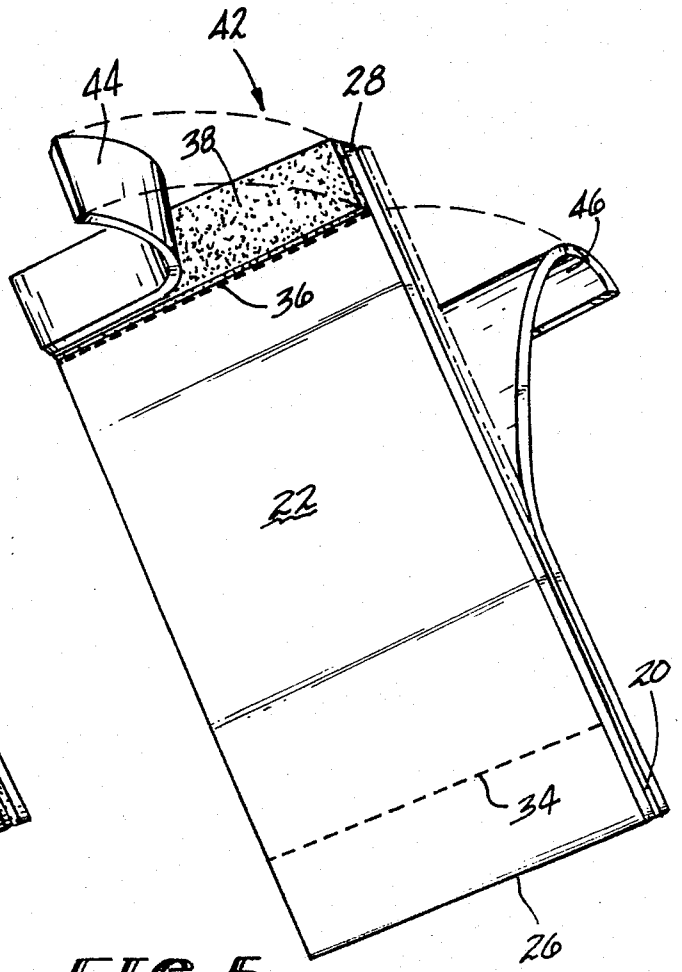
FIG. 5 is a perspective view of the completed composite page as seen generally from the top thereof.
Figure 6:
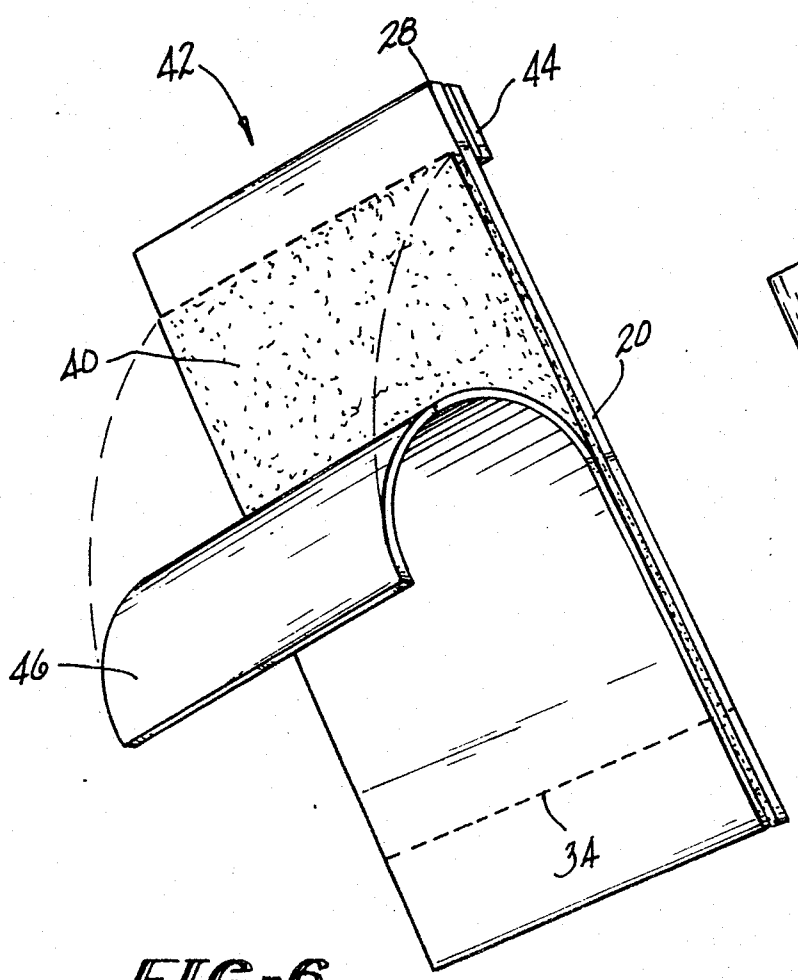
FIG. 6 is a perspective view of the completed composite page as seen generally from the bottom thereof.

FIG. 5 shows completed composite page 42 as seen generally from the top thereof, while FIG. 6 shows completed composite page 42 as seen generally from the bottom thereof. FIG. 5 shows both release paper 44 and release paper 46 partially removed, and FIG. 6 shows release paper 46 partially removed.

Figure 7:
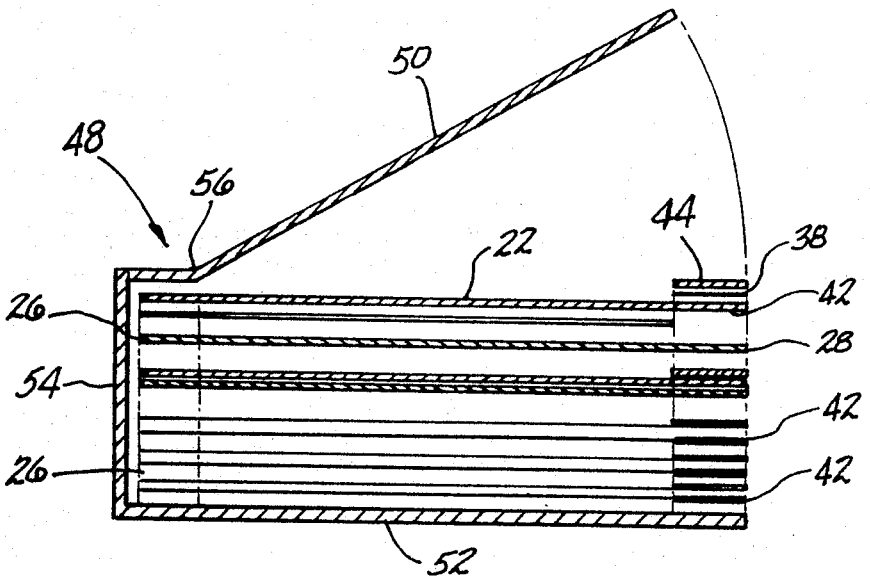
FIG. 7 is a somewhat schematic view showing in longitudinal section a pad with a cover, the pad being a preferred embodiment of the invention.

FIG. 7 shows a pad 48 which is a preferred embodiment of the invention. Pad 48 has a cover 50, a bottom 52 and a bight portion 54 connecting cover 50 and bottom 52. Cover 50 is hinged to bight portion 54 along a line 56 and is movable between an illustrated open position and a closed position.

A plurality of like composite pages 42 are stacked on top of one another and with bindable ends 26 of sheets 20 bound within bight portion 54 and with top surfaces 22 of all composite pages 42 facing cover 50. Bindable ends 26 are aligned with each other and free ends 28 are aligned with each other.

Cover 50 is substantially longitudinally coextensive with composite pages 42 to overlie same completely when in the closed position.

Upper surface 22 of each page 42 may be a printed form on which information can be entered in pencil or pen or it may be completely blank. In any event, information may be written on surface 22 of topmost page 42, with pad cover 50 in its open position.

Adhesive layer 40 on bottom surface 24, when release paper 46 is removed, will adhere to either the outside of a roll of film or the back of a developed photograph, with top surface 22 exposed.

Page 42 can be readily separated along perforation lines 34 and 36 to remove the portion of page 42 between perforation lines 34 and 36 from pad 48, whereupon the removed portion of page 42 can be adhered to the outside of a roll of film or the back of a photograph, as mentioned above.

Figure 8:
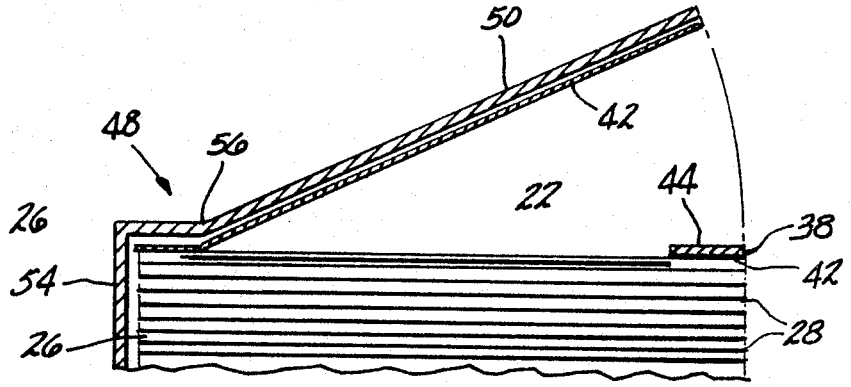
FIG. 8 is a fragmentary view similar to FIG. 7 but showing a page of the pad adhered to the cover of the pad.

Furthermore, free end 28 of uppermost page 42 in pad 48 is so located with respect to cover 50 that when upwardly facing release paper 44 is removed from uppermost page 42, to expose adhesive layer 38 thereof, cover 50 can be moved to the closed position and stick to adhesive layer 38 of uppermost page 42, thus to pick up uppermost page 42, whereby when cover 50 is thereafter moved to the open position, uppermost page 42 will move with cover 50 to expose next lower page 42, with its release paper 44 facing upwardly, and its upper surface 22 positioned to be written on, all as shown in FIG. 8. It is to be noted that release paper 44 of next lower page 42 can be removed to expose adhesive layer 38 thereof and cover 50 moved to the closed position to cause uppermost page 42 (which is already adhered to cover 50) to adhere to adhesive layer 38 of next lower page 42 which will thereafter move with cover 50 to expose a still lower page 42, and so on.

Note that after any page 42 is, or pages 42 are, adhered directly or indirectly to cover 50, it is a simple matter to separate from pad 48 the central portion of lowermost page 42 which is movable with cover 50, along perforation lines 34 and 36.

Release paper 46 can then be removed from the so removed central portion which can then be affixed, via its adhesive layer 40 to the outside of a roll of film or an individual photograph.

It is evident that the invention achieves the objects and advantages set forth above and other objects and advantages.

The disclosed details are exemplary only and are not to be taken as limitations on the invention except as those details are included in the appended claims.

What is claimed is:

1. A composite page for use as a component of a pad including a stack of like composite pages, said composite page comprising a paper sheet having a top surface, a bottom surface, a bindable end, a free end, sides joining said ends, a first perforation line spaced from said bindable end and joining said sides, and a second perforation line between said first perforation line and said free end, a first layer of pressure sensitive adhesive material on said top surface and localized on the portion thereof between said free end and said second perforation line, a second layer of pressure sensitive adhesive material on said bottom surface and covering at least partly the portion thereof between said first and second perforation lines, a first removable piece of release paper covering said first layer of adhesive material and a second removable piece of release paper covering said second layer of adhesive material.

2. The composite page according to claim 1 wherein said bindable end, said free end and said sides define a rectangle and said perforation lines are parallel and perpendicular to said sides.

3. The composite page according to claim 2 wherein said perforation lines are equispaced from said ends.

4. The composite page according to claim 3 wherein the distance between said perforation lines is about 75% of the distance between said ends.

5. The composite page according to claim 1 wherein said top surface can accept writing thereon between said first and second perforation lines.

6. The composite page according to claim 1 wherein said second layer of adhesive material is localized on the portion of said bottom surface between said perforation lines.

7. The composite page according to claim 6 wherein said second layer of adhesive material covers all the portion of said bottom surface between said perforation lines.

8. A pad comprising a plurality of like composite sheets each according to claim 1, said sheets being stacked together in the same orientation with said bindable ends bound together and said top surfaces facing upward, and a pad cover movable between an open position and a closed position overlying said free ends of said sheets.

9. A pad comprising a plurality of like composite sheets each according to claim 2, said sheets being stacked together in the same orientation with said bindable ends bound together and said top surfaces facing upward, and a pad cover movable between an open position and a closed position overlying said free ends of said sheets.

10. The pad according to claim 9 wherein said pad cover is hingedly movable about a hinge line above and parallel to said first perforation line.

11. The pad according to claim 10 further comprising a bottom underlying the bottom most one of said composite sheets and a bite portion connecting said cover and said bottom.

* * * * *